United States Patent [19]

Luke

[11] Patent Number: 4,724,848

[45] Date of Patent: Feb. 16, 1988

[54] SMOKING ARTICLE FILTERS

[75] Inventor: John A. Luke, Eastleigh, England

[73] Assignee: British-American Tobacco Company Limited, London, England

[21] Appl. No.: 579,342

[22] Filed: Feb. 13, 1984

[51] Int. Cl.[4] ..... A24D 3/04

[52] U.S. Cl. ..... 131/336; 131/361

[58] Field of Search ..... 131/336, 361

[56] References Cited

U.S. PATENT DOCUMENTS

| | | | |
|---|---|---|---|
| 4,232,574 | 11/1980 | Hall | 131/336 |
| 4,343,319 | 8/1982 | Cantrell | 131/336 |
| 4,406,295 | 9/1983 | Sanford et al. | 131/336 |

*Primary Examiner*—V. Millin

*Attorney, Agent, or Firm*—Kane, Dalsimer, Sullivan, Kurucz, Levy, Eisele and Richard

[57] ABSTRACT

A smoking article comprises a wrapped rod of smoking material, a filter element and a tipping wrapper by which the rod and filter element are interattached. The filter element comprises a body of fibrous filtration material and paper wrapper securing the filtration material. Opening means is provided in the paper wrapper extending longitudinally along the filter element and providing at least one ventillation-air distribution space bounded by the tipping wrapper. Ventilation air is permitted to ingress into the space at a first location, whereby air may flow through the space and then to enter the filtration material at a second location spaced longitudinally from the filter element. The smoking article of the invention has a number of advantages and represents an advance in the art in that it makes possible a more direct and better distributed flow of ventilation air into wrapped filter elements of smoking articles containing such elements.

9 Claims, 5 Drawing Figures

FIG. 1.
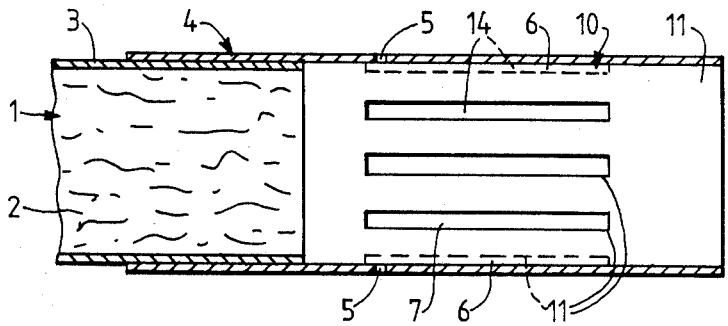
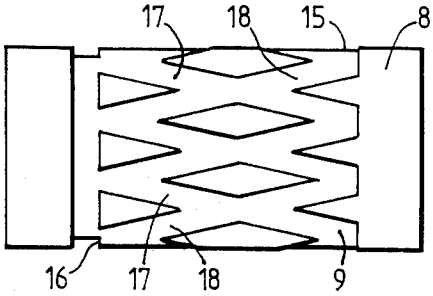
FIG. 2.
FIG. 3.
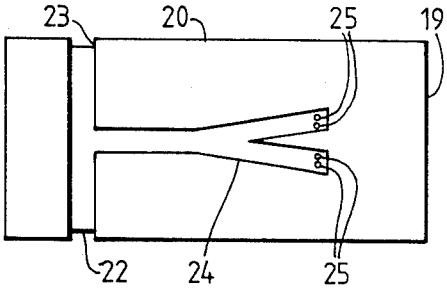
FIG. 4.
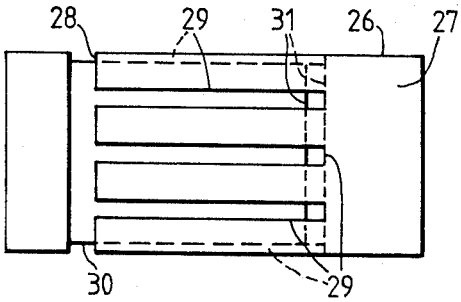
FIG. 5.
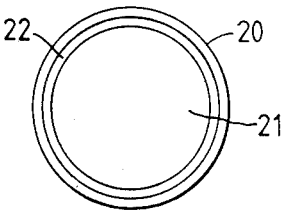

SMOKING ARTICLE FILTERS

This invention relates to filters for smoking articles, cigarettes for example.

It is common in present-day filter-tipped cigarettes for the filter to comprise a filter element of fibrous filtration material, cellulose acetate for example, wrapped in air-permeable plug-wrap paper and for a low permeability tipping wrapper serving to interattach the filter element and the cigarette rod to be provided with a zone of ventilation perforations. When, during the smoking of a cigarette possessing these features, ventilation air is drawn into the filter element through the ventilation perforations in the tipping wrapper, the air encounters the plugwrap before the air enters the body of filtration material. The plugwrap not only presents a degree of resistance to air flow, albeit a comparatively small one, but it also acts to restrict free distribution of the ventilation air entering the filtration material.

It is an object of the present invention to make possible a more direct and better distributed flow of ventilation air into wrapped filer elements.

The present invention provides a smoking article, a cigarette for example, comprising a wrapped rod of smoking material, a filter element and a tipping wrapper serving to interattach said rod and said filter element, said filter element comprising a body of fibrous filtration material wrapped in a paper wrapper, a portion or portions of which paper wrapper extending along said element having been removed, thereby providing a ventilation-air distribution space or spaces bounded by said tipping wrapper, and said tipping wrapper permitting the ingress of ventilation air into said space or spaces at a first location, whereby the ventilation air may flow through said space or spaces and enter said body of filtration material at a second location or locations spaced longitudinally of said element from said first location.

The portion or portions of the paper wrapper may be removed after the wrapper has been wrapped about the body of filtration material, the removal being affected by a cutting or grinding process or by bringing the wrapper into contact with a heated former. With some configurations of the removed portion or portions it is possible to effect removal thereof before the paper wrapper is applied to the body of filtration material.

The filter element may comprise a further wrapper underlying the first mentioned, and therefore outer, paper wrapper. In such case, the removal of a portion or portions of the outer wrapper exposes a portion or portions of said further wrapper.

The fibrous filtration material may be or may include, for example, cellulose acetate, polypropylene or polyethylene.

In order that the invention may be clearly understood and readily carried into effect, reference will now be made, by way of example, to the accompanying diagrammatic drawings, in which:

FIG. 1 shows parts of a filter-tipped cigarette, a tipping wrapper and part of a tobacco rod being shown in axial section.

FIGS. 2–4 show respective filter elements each of which could be substituted for the filter element of the cigarette of FIG. 1; and FIG. 5 shows a mouth-end view of the filter element of FIG. 3.

The filter-tipped cigarette of FIG. 1 comprises a cigarette rod 1, of tobacco filler 2 wrapped in a cigarette paper 3, a filter element 10, of fibrous cellulose acetate filtration material wrapped in paper plugwrap 11, and a paper tipping wrapper 4 serving to interattach the cigarette rod 1 and the filter element 10. The plugwrap 11, which is of a paper somewhat heavier than conventional plugwrap, is provided with a number of rectangular slots 14 equiangularly spaced around the element 10. Each of the slots 14 extends parallel to the axis of the element 10 from an upstream location spaced from the tobacco end of the element to a downstream location spaced from the mouth end of the element 10. The slots 14 were cut in the plugwrap 11 prior to the filter-rod making process which provided the rod from which the filter element 10 was cut.

The tipping wrapper 4 is provided with a ring of ventilation perforations 5, the ring being so located along the element 10 and the perforations 5 being of such size and spacing that at least one of the perforations 5 commmunicates with each of the slots 14 at an upstream end region thereof. The slots 14, together with the tipping wrapper 4 and the cellulose acetate filtration material exposed within the area of each slot 14, and designated 7, define ventilation-air distribution spaces in the form of channels 6. Thus, during smoking of the cigarette, ventilation air may enter the channels 6 through the perforations 5 and enters the interior of the element 10 over an extended peripheral area thereof. A proportion of the ventilation air will travel along the full length of each of the channels 6 before entering the body of cellulose acetate filtration material.

A form of filter element 15 alternative to the element 10 of FIG. 1 is shown in FIG. 2. The element 15 comprises a plugwrap 8 of comparatively heavy paper. Prior to the element 15 having been cut therefrom, the element 15 formed part of a filter rod of a length equivalent to six unit elements. The rod was rolled in contact with a heated former (not shown) of such configuration as to burn away portions of the plugwrap 8 to provide an annular groove 16 and, extending along the element 15 from the downstream side of the groove 16 to locations short of the mouth end of the element 15, two series of grooves 17, 18 which follow helical paths of opposite hand. The bases of the grooves 16–18 are constituted by the peripheral surface designated 9, of a body of fibrous filtration material enwrapped by plugwrap 8. Thus, when the filter element 15 is attached to a cigarette rod by tipping having ventilation perforations in communication with the annular groove 16, and the resultant cigarette is smoked, ventilation air passes from the groove 16 to the grooves 17, 18 and enters the interior of the element 15 over an extended peripheral area thereof.

Filter element 19 of FIGS. 3 and 5 comprises a heavy paper wrapper 20, fibrous filtration material 21, and a further wrapper 22 intermediate the wrapper 20 and the filtration material 21. A six times unit length filter rod from which the element 19 was cut was rolled in contact with a heated former of such configuration as to burn out portions from the wrapper 20 to provide an annular groove 23 and, extending therefrom, a number of Y-form grooves 24, only one of which is shown. The grooves 23 and 24 are not so deep as to extend through the wrapper 22. The wrapper 22 is provided with a ring of ventilation perforations 25 at a distance along the element 19 such that they are disposed at a right-hand end region, as seen in FIG. 3, of the Y-form grooves 24.

The size and spacing of the perforations is such that at least one perforation communicates with each of the two divergent limbs of each of the grooves 24.

When the filter element 19 is attached to a cigarette rod by tipping having ventilation perforations in communication with the annular groove 23, ventilation air can flow from the groove 23 along the grooves 24 and thence into the body of filtration material 21 through the ventilation perforations 25. The wrapper 22 may be of conventional paper plugwrap material but is suitably of a paper containing thermoplastic fibres or is a thermoplastic film material. The wrapper 22 may be of low or substantially zero air permeability.

Filter element 26 of FIG. 4 comprises a paper wrapper 27 which has had portions burned out of it to provide an annular groove 28 and, extending from the groove 28 longitudinally of the element 26, a number of grooves 29. The configuration of the grooves 29 is similar to that of the grooves 14 of the filter element 10 of FIG. 1. However, whereas the bases of the grooves 14 are constituted by the peripheral surface of a body of fibrous filtration material 7, the bases of the grooves 29 of the element 26 are constituted by a further wrapper 30. Before the wrapper 27 was applied over the wrapper 30 in the manufacture of the element 26, a strip of the wrapper 30 was removed to provide an annular groove 31. The base of the groove 31 is constituted by the peripheral surface of a body of fibrous filtration material enwrapped by the wrapper 30. In the completed element 26, the expcsed portion of the filtration material overlaps or intersects end zones of the grooves 29 in the wrapper 27.

When the filter element 26 is attached to a cigarette rod by tipping having ventilation perforations in communication with the annular groove 28, ventilation air can flow from the groove 28 along the grooves 29 into the annular groove 31, from which last mentioned groove the air passes into the body of filtration material.

The wrapper 30 is preferably of low or substantially zero air permeability. The removal of the strip from the wrapper 30 to provide the annular groove 31 may be effected by contact with a heated former prior to the application of the wrapper 27 over the wrapper 30.

The wrapper 30 may be of conventional paper, of paper having a content of thermoplastic fibres, or of a thermoplastic film material.

In the above-described filter elements the fibrous filtration material may, as an alternative to cellulose acetate, be, for example, polypropylene or polyethylene. Mixtures of two or more types of fibres may be employed.

Conveniently the portions removed from the wrappers 8, 20 and 27 are removed by moving the respective filter rods and heating forming means relatively of each other in an arcuate path, in a direction transverse the longitudinal axis of the rod, although a straight path of relative movement would also be appropriate. An apparatus of a type which could be utilised for heat removal or portions of paper plugwrap is described in United Kingdom Patent Specification No. 1,507,765.

What is claimed is:

1. A smoking article comprising a wrapped rod of smoking material, a filter element and a tipping wrapper by which said rod and said filter element are interattached, said filter element comprising a body of fibrous filtration material of constant cross-section throughout its length and a paper wrapper wrapped around said body of fibrous filtration material, openings through said paper wrapper extending lengthwise of but short of the ends of said element providing at least one ventilation-air distribution space bounded by said tipping wrapper, and means permitting the ingress of ventilation air into said space at a first location, whereby ventilation air may flow along said space, said space being in ventilation air flow communication with said body of filtration material at a second location spaced downstream of said first location.

2. A smoking article according to claim 1 and comprising a further wrapper underlying the first-mentioned, paper, wrapper.

3. A smoking article according to claim 1, wherein said opening means is formed in the wrapper paper after the paper wrapper has been wrapped about the body of filtration material, to expose at least one portion of said filtration material.

4. A smoking article according to claim 1, wherein a further wrapper underlies the first-mentioned, paper, wrapper, said opening means exposing a portion of said further wrapper, and said further wrapper permitting the ingress of ventilation air into said body of filtration material as said second location.

5. A smoking article according to claim 1, wherein said opening means of the paper wrapper are formed before the said wrapper is applied to the body filtration material.

6. A smoking article according to claim 1, wherein said opening means of said paper wrapper is formed by a process of the type which comprises cutting, grinding and heat-forming.

7. A smoking article according to claim 1, wherein said paper wrapper is furnished with a plurality of substantially rectangular slots spaced around the filter element.

8. A smoking article according to claim 7, wherein said tipping wrapper is provided with a ring of ventilation perforations disposed for communicating with respective said slots.

9. A smoking article according to claim 7, wherein said slots, together with said tipping wrapper and the filtration material exposed within the area of respective slots define ventilation-air distribution spaces in the form of grooves.

* * * * *